United States Patent [19]

Herbert et al.

[11] Patent Number: 4,627,545

[45] Date of Patent: Dec. 9, 1986

[54] CAR COUPLER WITH ENLARGED GATHERING ZONE

[75] Inventors: Donald L. Herbert, Lexington; Lynn A. Schneider; Zoltan Kovacs, both of Mansfield, all of Ohio

[73] Assignee: Harvey Hubbell Incorporated, Orange, Conn.

[21] Appl. No.: 620,486

[22] Filed: Jun. 14, 1984

[51] Int. Cl.[4] ..... B61G 3/00

[52] U.S. Cl. ..... 213/100 R; 213/100 W; 213/104

[58] Field of Search ..... 213/100 R, 100 W, 104, 213/105, 109, 75 R, 77, 90, 93, 95

[56] References Cited

U.S. PATENT DOCUMENTS

| | | | |
|---|---|---|---|
| 1,201,665 | 10/1916 | Willison | 213/100 R |
| 1,896,959 | 2/1933 | Kürtössy | 213/100 R |
| 2,246,406 | 6/1941 | Wittmer | 213/104 |
| 2,963,174 | 12/1960 | Metzger | 213/104 |
| 3,128,886 | 4/1964 | De Penti | 213/100 R |
| 3,390,788 | 7/1968 | De Moulliac | 213/100 R |
| 3,405,811 | 10/1968 | Cope | 213/100 R |
| 3,655,066 | 4/1972 | Metzger | 213/100 R |
| 4,073,385 | 2/1978 | Reed | 213/100 R |

*Primary Examiner*—David A. Scherbel
*Assistant Examiner*—Donald T. Hajec
*Attorney, Agent, or Firm*—Jerry M. Presson; Walter C. Farley

[57] ABSTRACT

A hook-type railroad car coupling includes a hook vertically centered and laterally offset in a pocket opening in the front face and a guide pin and hole at opposite top corners. At one side of the bottom a guide horn extends beyond the hook, the front plate having an opening beside the horn and below the hook. A guide wedge is inside the opening to contact the horn of the mating head and improve the parallelism of the front faces of the heads as they come together.

12 Claims, 12 Drawing Figures

CAR COUPLER WITH ENLARGED GATHERING ZONE

This invention relates to hook-type railroad car couplers and particularly to improved means for increasing the gathering range of such couplers.

BACKGROUND OF THE INVENTION

In automatic hook-type couplers, it is desirable to have a gathering range which is sufficiently large to permit engagement and alignment of coupler heads from initial conditions of misalignment which are largely a function of operating circumstances. In certain transit and other applications, it has become necessary to enlarge this range or zone beyond that which is currently available. However, this must be done without significantly increasing the outer dimensions of the coupler head.

Presently, the gathering range is determined by hook and pocket configurations and, in a 2.5 inch hook coupler, the gathering zone, viewed in a vertical plane, is a non-symmetrical region which is about 8.25 inches wide and about 6 inches high at the largest point. This is not sufficient to satisfy present needs.

Examples of couplers of the general type to which the invention relates can be found in U.S. Pat. Nos. 3,405,811, Cope; 3,655,066, Metzger; and 4,073,385, Reed. Metzger is of particular interest as an example of the prior art as well as for its discussion of the general problem.

A hook-type coupler of this general type includes a head with a generally flat front face and an opening through the face which forms a pocket. A hook protrudes through the pocket, offset to one side, and is designed to engage a similar hook in a mating coupler head. The face also has at least one protruding alignment pin, generally with a tapered end, and an opening for receiving a similar pin in the other head. Various surfaces of the pocket opening, hook alignment pin, and pin socket are slanted in various ways so that they can guide each other toward alignmcnt.

However, there are distinct limitations on the sizes of such surfaces and the dimensions of the protruding components, placing upper limits on the gathering range.

An additional constraint is imposed by the presence of electric coupler heads, particularly side mounted electric coupler heads, which have electrical contact sets to be engaged as the mechanical coupler parts are joined. It has been found that previously used mechanical couplers sometimes approach each other in such a way that the contact sets are misaligned and are seriously damaged. This is believed to occur because the flat faces of the mechanical heads are not always parallel with each other during the last stages of the coupling operation.

BRIEF SUMMARY OF THE INVENTION

Accordingly, it is an object of the present invention to increase the dimensions of the gathering zone, particularly horizontally but also vertically, in a hook-type coupler without significantly increasing the coupler head vertical and horizontal dimensions.

A further object is to provide such a coupler in which the means for increasing the gathering zone size is simple and reliable and does not add excessively to the manufacturing costs of the coupler head.

A further object is to provide a coupler including means for more accurately aligning the faces of the coupler in parallel relationship at the end of the coupling operation.

Briefly described, the invention includes a car coupling head with an enlarged gathering zone matable with a substantially identical head on another car, the head comprising the combination of a housing having a generally rectangular front plate with a generally flat face and upper and lower horizontal edges, the plate having a rectangular pocket opening through the front plate, the longer dimension of the pocket opening being horizontal. A hook is pivotally mounted in the housing for movement about a vertical axis, the hook being sufficiently long to extend through the pocket opening with a portion thereof protruding beyond the front face. The hook is offset toward one side of the head so that a majority of the protruding portion lies on one side of the horizontal center line of the head. A guide pin protrudes from an upper (or lower) corner of the front plate and the plate is provided with a hole at the other upper (or lower) corner to receive a guide pin of the mating head. A guide horn is mounted near either the top or the bottom of the front plate and protrudes from the face of the plate below or above the hook so that its inwardly facing surface is vertically offset from the closest surface of the hook, the horn being laterally offset from the center line on the other side from the hook. Adjacent the horn is an opening for receiving the horn of the mating head.

Additionally, the horn and hook have inwardly facing slanted surfaces which cooperate with portions of the other head to align the heads for coupling.

Still further, each head is provided with a centering wedge disposed at one side of the horn-receiving opening, opposite the horn itself, to cooperate with the opposite horn in alignment.

In order that the manner in which the foregoing and other objects are attained in accordance with the invention can be understood in detail, a particularly advantageous embodiment thereof will be described with reference to the accompanying drawings, which form a part of this specification, and wherein.

Referring first to FIGS. 1, 2, 3 and 7, it will be seen that the coupling head indicated generally at 10 is mounted at the end of a conventional tube 12 which is pivotably coupled in a known manner to a railway car. The head includes a housing 14 having a front plate 16 which is intended to abut a similar plate of a mating coupling in the coupled relationship.

Figure 1:
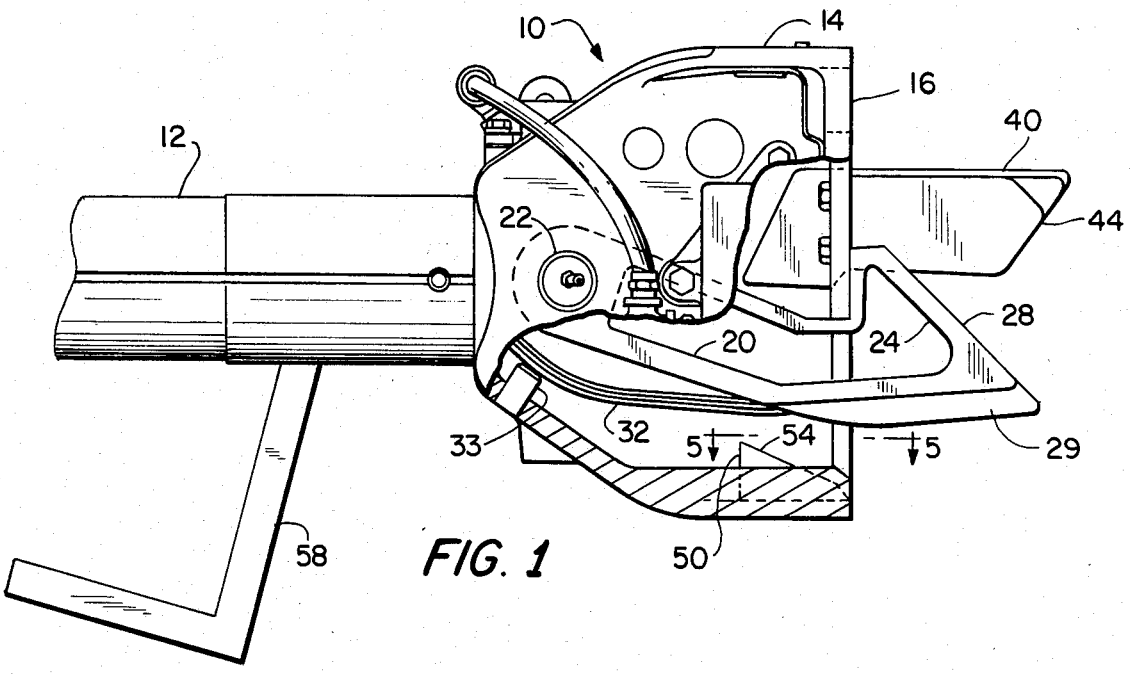
FIG. 1 is a top plan view, in partial section, of a coupler in accordance with the invention.
Figure 2:
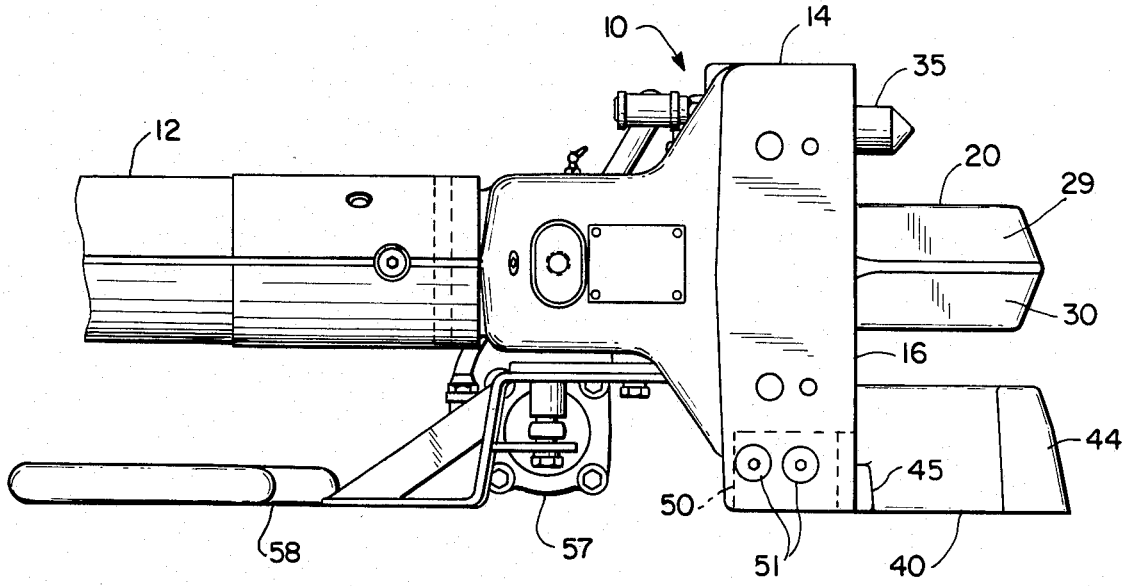
FIG. 2 is a side elevation of the coupler head of FIG. 1.
Figure 3:
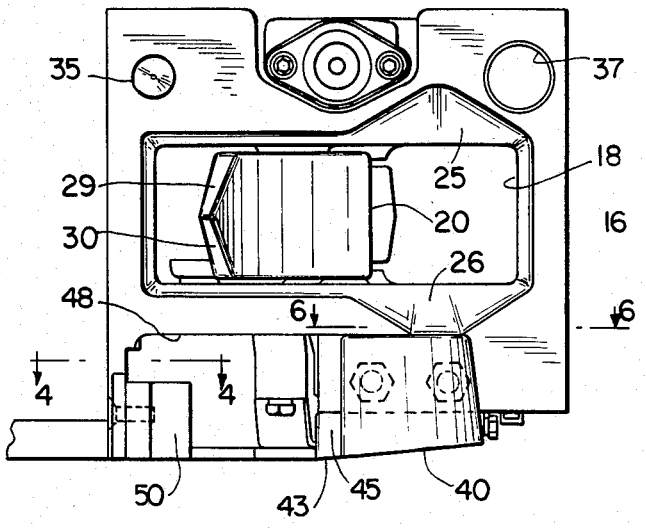
FIG. 3 is an end view of the apparatus of FIGS. 1 and 2.
Figure 7:
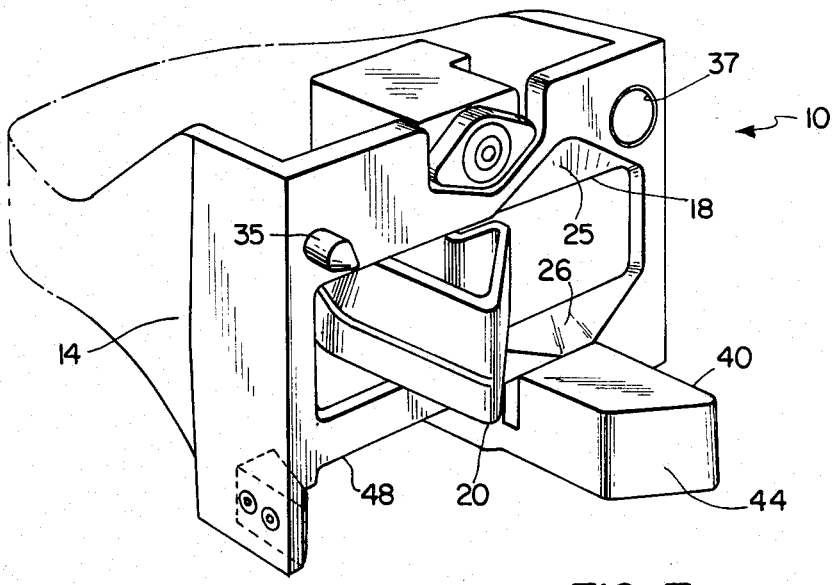
FIG. 7 is a perspective view of the end of the coupler head of FIGS. 1–3.

As best seen in FIGS. 3 and 7, plate 16 is provided with an opening 18 which extends through the plate and which is generally rectangular, the longer dimension being horizontal. A hook 20 is pivotally connected within housing 14 to a hook pin 22 so that the hook is capable of pivotal movement about a generally vertical axis. The hook extends through opening 18 and is laterally offset so that a protruding portion 24 of the hook lies to one side of opening 18, the other side of the pocket being available to receive the hook of the mating connector. As will be seen in FIG. 1, the great majority of the protruding portion of the hook lies to the right, as viewed from the car on which the coupling head is mounted, of the longitudinal center line of the coupling head which normally passes through the axis of pivot pin 22. As seen in FIGS. 3 and 7, upper and lower surfaces 25 and 26 of the portion of the plate surrounding opening 18 slope inwardly toward the opening to guide the opposing hook into the pocket, primarily to correct for vertical misalignments. The vertical sides of the opening are similarly inclined to guide in a lateral direction.

The forward end of hook 20 is provided with a face 28 which lies in a generally vertical plane and which makes an angle of about 46.5° with the longitudinal axis of the head. The outwardly facing portion of the hook is formed with two surfaces 29 and 30 which are inclined at a relatively shallow angle and meet approximately at the horizontal center line of the hook as well as opening 18 and plate 16. It will be observed that the vertical dimension of opening 18 is approximately one-third of the height of plate 16 and lies in the center of the plate.

A hook spring 32, which is generally a compound leaf spring, is attached within tube 12 and extends through the housing to engage the back surface of hook 20, restraining the hook from motion to its right, again as viewed from the car to which the head is connected. The position of spring 32 is determined in part by a spring stop 33.

One upper corner of the plate is provided with a guide pin 35 and the opposite corner is provided with an opening which receives a guide pin bushing 37 to receive the equivalent guide pin on the mating head.

Figure 6:
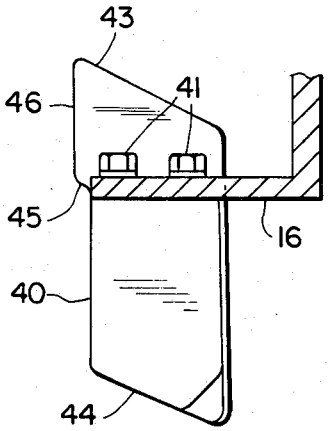
FIG. 6 is a sectional view along line 6—6 of FIG. 3.

At the bottom of plate 16 below opening 18 is a protruding guide horn 40 which is fixedly attached, as best seen in FIG. 6, to front plate 16 by machine screws 41 which extend through plate 16 and into the rear wall of horn 40. Also as seen in FIG. 6, horn 40 has a rear portion 43 the upper surface of which is below the heads of fasteners 41.

It will be observed that guide horn 40 lies on the opposite side of the center line of the coupling head from the majority of hook 20, and that the forward end of the horn is provided with a laterally inwardly facing surface 44 which lies in a generally vertical plane intersecting surface 28 of hook 20. The top horizontal surface of the horn faces inwardly and is vertically offset from the closest surface of hook 20. The outer surface of horn 40 is inclined outwardly and downwardly. A rear portion 43 of the horn is formed with a curved portion 45 and a rearwardly extending, inwardly facing surface 46 which are capable of acting as guide surfaces as will be described.

Figure 4:
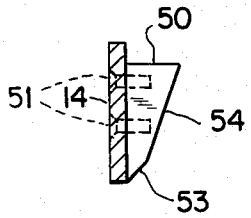
FIG. 4 is a sectional view along line 4—4 of FIG. 3.
Figure 5:
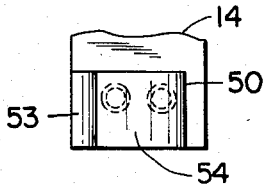
FIG. 5 is a sectional view along line 5—5 of FIG. 1.

Adjacent horn 40 and below opening 18 and hook 20 is a horn-receiving opening 48 which is shaped and dimensioned to receive the horn of the mating coupler. Attached to the inner surface of the side wall of housing 14 is a guide wedge 50, shown in greater detail in FIGS. 4 and 5. Guide wedge 50 is connected by machine screws 51 and presents a compound inclined surface having a forward portion 53 and a rear portion 54 to cooperate with the horn of the opposite connector to align the heads during the passage of the horn into opening 48.

The apparatus also includes various other devices such as an uncoupling cylinder 57 which is actuated by an uncoupling lever 58. Additionally, there are various hoses, valves and other components associated with the pneumatic aspects of the coupling head. However, these aspects of the system are not involved with the guidance function which are the primary aspects of the present invention and are conventional in nature and will therefore not be further described.

Figure 9:
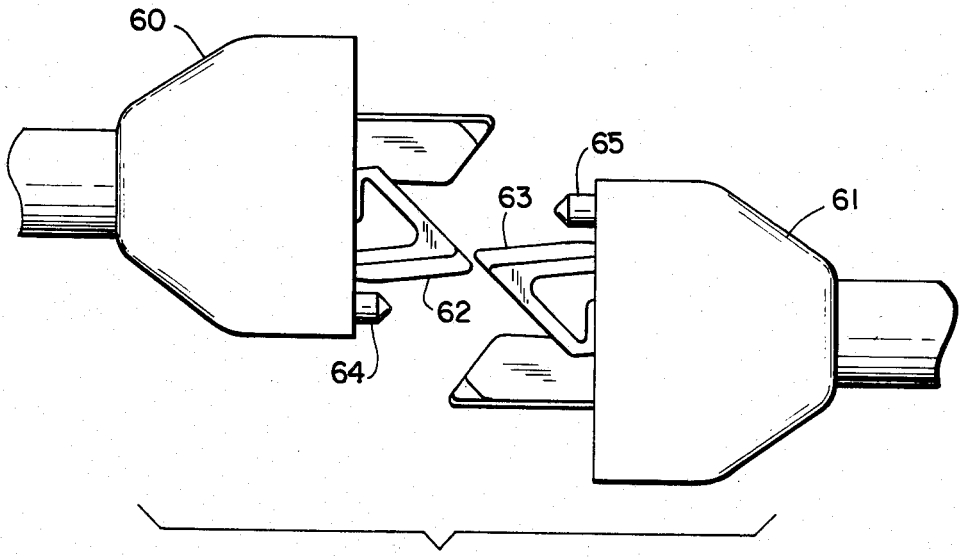

As will be readily recognized by those skilled in the art, misalignment situations can occur in either a horizontal or a vertical plane, and a common misalignment situation is illustrated in FIG. 9 in which a head 60 and a head 61 are to be coupled together. In this condition, the slanted forward surface of hook 62 engages the counterpart surface of hook 63 on head 61 and causes the heads to move toward an aligned condition in which alignment pins 64 and 65 can enter the holes provided for that purpose in the front faces of the coupling heads.

Figure 8:
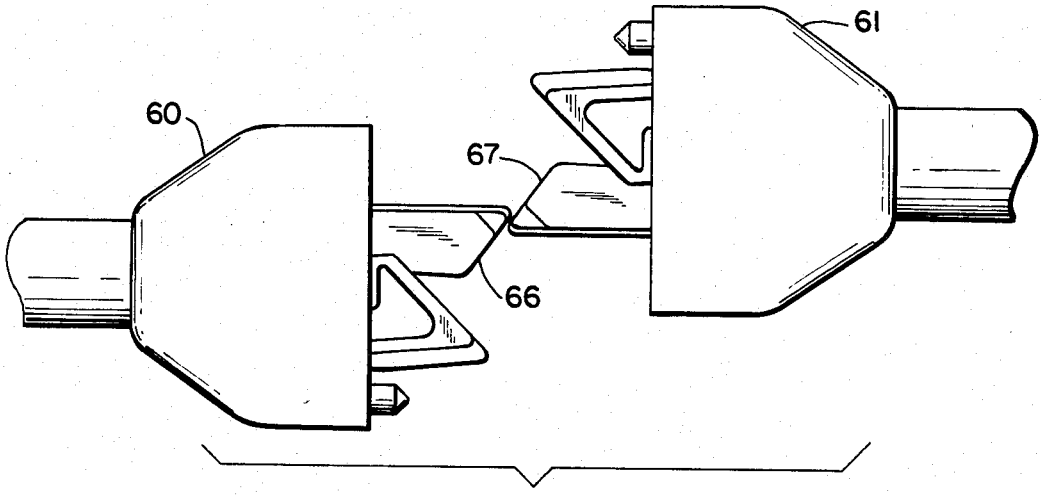
FIGS. 8, 9 and 10 are schematic views of a pair of coupler heads in accordance with the invention showing various possible arrangements of non-alignment thereof.

However, a situation such as that illustrated in FIG. 8 would not result in alignment, prior to the present invention, because there was no technique for moving the heads from misalignment in that direction to the extent illustrated. In other words, there was no provision for moving the heads to the left from a major misalignment. In accordance with the present structure, horns 66 and 67 on heads 60 and 61, respectively, engage each other with their inwardly facing sloping front surfaces, causing relative movement of the heads into the necessary alignment.

Figure 10:
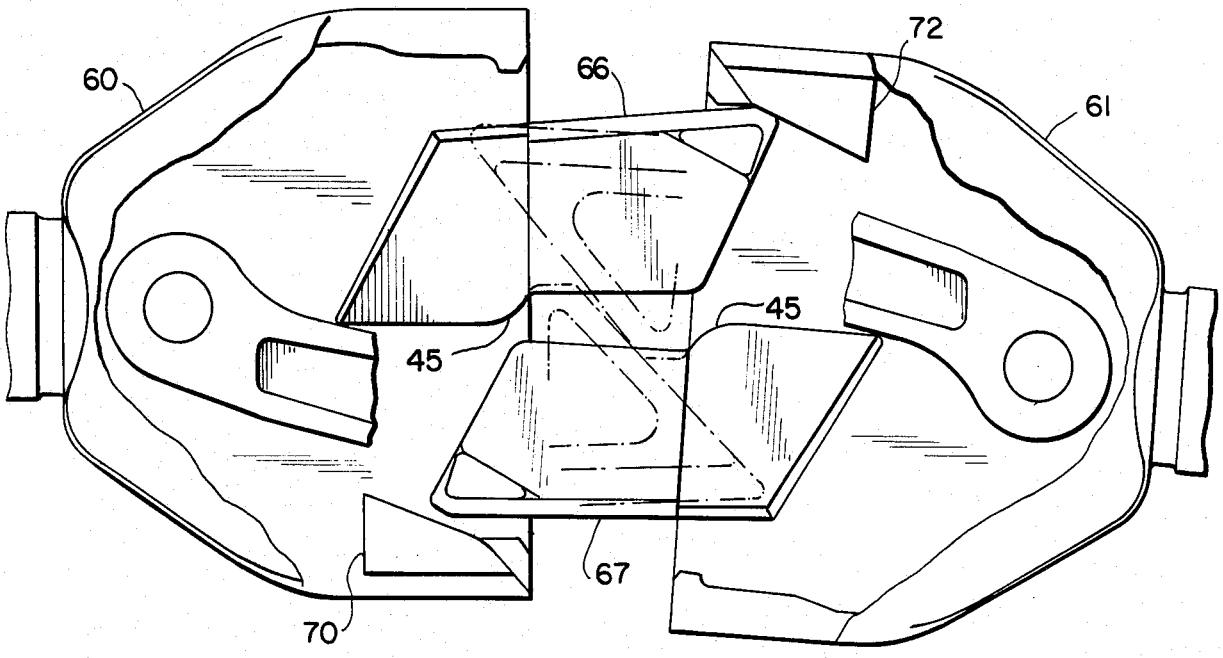

Toward the final stages of alignment, it is possible for the heads to reach a condition such as that illustrated in FIG. 10 in which the horns have entered the horn-receiving openings and the front-facing surfaces of the hooks are sliding against each other but with the facing surfaces of the coupler heads in a non-parallel relationship. When this condition exists, the electrical contacts of sidemounted contact heads can be damaged. The electrical contact sets are conventional in nature and are therefore not illustrated. Wedges 70 and 72 are provided inside of the housing along the edges opposite the horns to correct this non-parallel condition, the wedges having inwardly facing, inclined surfaces to contact the ends of the horns and pivot one or both heads until the faces are parallel. As also seen in FIG. 10, the curved surfaces 45 of the horns which protrude laterally towards the wedges 70 in each head are available to contact the ends of the opposite horns if the misalignment is sufficiently great, urging the horns towards the wedges.

Figure 11:
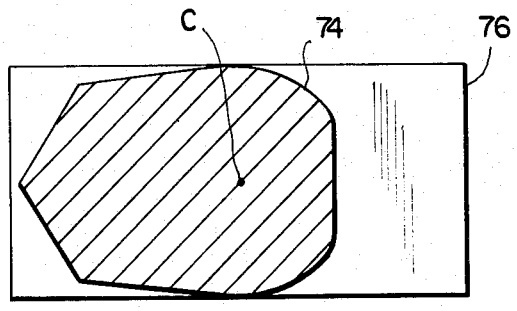
FIG. 11 PRIOR ART
FIGS. 11 and 12 are diagrams illustrating relative gathering zones of the prior art and of the present invention.
Figure 12:
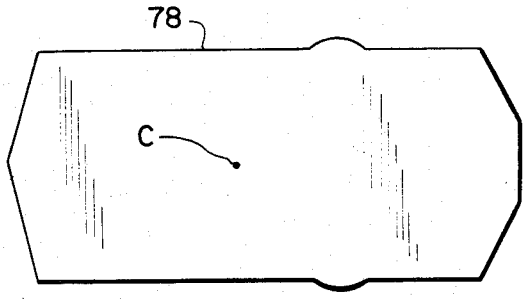

FIG. 11 is an approximate map of the gathering zone 74, the shaded region, of a prior art coupling, depicted for purposes of comparison with a region 76 which is an idealized map of a desired gathering zone for a coupler of this general type. FIG. 12 is a map of the gathering zone of a coupler in accordance with the present invention. In each case, the point C indicates the position of the center of the coupling. It will be recognized that the center point C of the opposite coupling must be within the region of the gathering zone in order for coupling to take place. It will be recognized from the figures that the zone 78 of the present invention is an extremely close approximation to the desired zone 76, and is a considerable improvement over the zone 74 of the prior art.

As will be recognized, in the foregoing description the use of terms such as upper and lower is convenient to describe the specific embodiment of the coupler disclosed herein. However, these terms are merely relative and appropriate to the illustrations and it is possible to completely invert the structure if desired, having horn 40 above hook 20 rather than below it.

While one advantageous embodiment has been chosen to illustrate the invention it will be understood by those skilled in the art that various changes and modifications can be made therein without departing from the scope of the invention as defined in the appended claims.

What is claimed is:

1. A car coupling head with an enlarged gathering zone matable with a substantially identical head on another car comprising the combination of a housing having a generally rectangular front plate with a generally flat face and upper and lower horizontal edges;

means defining a generally rectangular pocket opening through said front plate, the longer dimension of said pocket opening being horizontal;

a hook pivotally mounted in said housing for movement about a vertical axis, said hook extending through said pocket opening and having a portion protruding beyond said front face with a majority of the protruding portion lying to one side of the longitudinal center line of said head;

a guide member protruding from a first corner of said front plate and means defining a guide hole in a second corner of said front plate to receive the guide member of a mating head, said first and second corners being on substantially the same horizontal line;

a guide horn mounted near one of said horizontal edges of said front plate and protruding from the face thereof, said guide horn having an inwardly facing surface vertically offset from the closest surface of said hook, said horn being laterally offset from said longitudinal centerline to the other side from said hook;

means defining an opening adjacent said horn for receiving the horn of a mating head; and a guide wedge mounted in said housing adjacent an edge of said opening for engaging the horn of a mating head to align the respective flat faces of the heads in parallel relationship, said horn including a portion extending into said housing having a curved surface protruding laterally toward said wedge.

2. A coupling head according to claim 1 wherein the distal end of each of said horn and hook has a generally vertical surface inclined relative to the centerline of said head and facing toward said centerline.

3. A coupling head according to claim 2 wherein the vertical dimension of said pocket opening is equal to about one-third the height of said front plate, and wherein the vertical dimension of said hook is slightly less than said vertical dimension of said pocket opening.

4. A coupling head according to claim 3 wherein said majority of the protruding portion of said hook lies to the right side of the centerline of the head, as viewed from the pivotal mounting of said hook, and said horn lies to the left side of said centerline.

5. A coupling head according to claim 2 wherein said majority of the protruding portion of said hook lies to the right side of the centerline of the head, as viewed from the pivotal mounting of said hook, and said horn lies to the left side of said centerline.

6. A coupling head according to claim 1 wherein said majority of the protruding portion of said hook lies to the right side of the centerline of the head, as viewed from the pivotal mounting of said hook, and said horn lies to the left side of said centerline.

7. A coupling head according to claim 1 wherein the vertical dimension of said pocket opening is equal to about one-third the height of said front plate, and wherein the vertical dimension of said hook is slightly less than said vertical dimension of said pocket opening.

8. A car coupling head with an enlarged gathering zone matable with a substantially identical head on another car comprising the combination of a housing having a generally rectangular front plate with a generally flat face and upper and lower horizontal edges;

means defining a generally rectangular pocket opening through said front plate, the longer dimension of said pocket opening being horizontal;

a hook pivotally mounted in said housing for movement about a vertical axis, said hook extending through said pocket opening and having a portion protruding beyond said front face with a majority of the protruding portion lying to the right side of the longitudinal center line of said head as viewed from the pivotal mounting of said hook, said hook being substantially centered vertically in a horizontal plane bisecting said face of said front plate, said hook having a surface which faces to the right as viewed from the pivotal mounting of said hook and includes upper and lower generally planar faces intersecting at about said horizontal plane;

a guide member protruding from a first corner of said front plate and means defining a guide hole in a second corner of said front plate to receive the guide member of a mating head, said first and second corners being on substantially the same horizontal line;

a guide horn mounted near one of said horizontal edges of said front plate and protruding from the face thereof, said guide horn having an inwardly facing surface vertically offset from the closest surface of said hook, said horn being laterally offset from said longitudinal centerline to the other side from said hook; and means defining an opening adjacent said horn for receiving the horn of a mating head, including an inner edge, a first side edge adjacent said horn on said coupling and a second generally vertical side edge generally parallel with said first side edge, said coupling further comprising a guide wedge mounted in said housing adjacent said second side edge for engaging the horn of a mating head to align the respective flat faces of the heads in parallel relationship, said guide wedge having an inwardly facing generally vertical surface inclined inwardly away from said second edge, said horn including a portion extending into said housing having a curved surface protruding laterally toward said wedge.

9. A coupling head according to claim 8 wherein said guide wedge has first and second successive inwardly facing generally vertical surfaces lying in planes forming acute angles with said flat face.

10. A coupling head according to claim 9 wherein said first of said successive surfaces forms a smaller acute angle with said flat face than does said second surface.

11. A coupling head according to claim 8 wherein said horn is rigidly attached to said front plate and includes an outwardly facing surface which inclines outwardly and downwardly, and an end face lying in a generally vertical plane which is inclined relative to the housing centerline and intersects said hook.

12. A coupling head according to claim 8 wherein said horn protrudes beyond said flat face significantly farther than said hook.

* * * * *